United States Patent [19]

Pullen

[11] 4,014,240

[45] Mar. 29, 1977

[54] STRAP HOLDER ASSEMBLY

[76] Inventor: Charles E. Pullen, Pebble Hill Plantation, Thomasville, Ga. 31792

[22] Filed: Dec. 17, 1975

[21] Appl. No.: 641,520

[52] U.S. Cl. ..... 84/327; 84/280; 224/5 S

[51] Int. Cl.[2] ..... G10D 3/00; G10G 5/00

[58] Field of Search ..... 84/327, 280; 224/5 S, 224/5 R

[56] References Cited

UNITED STATES PATENTS

| | | | |
|---|---|---|---|
| 950,873 | 3/1910 | Smith | 84/280 |
| 2,061,464 | 11/1936 | Heimers | 84/280 |
| 2,576,018 | 11/1951 | Johnson | 224/5 S |
| 2,947,456 | 8/1960 | Seron | 224/5 S |
| 3,102,446 | 9/1963 | Raleigh | 224/5 S |
| 3,688,012 | 8/1972 | Vettel | 84/327 |
| 3,894,464 | 7/1975 | Brooks | 84/327 |

*Primary Examiner*—Stephen J. Tomsky
*Attorney, Agent, or Firm*—Duckworth, Hobby, Orman, Allen & Pettis

[57] ABSTRACT

One or more strap holder assemblies attached to a musical instrument or like device for purposes of attaching opposite ends or predetermined portions of a strap to the instrument or device wherein a base means is fixedly attached and specifically configured to form a socket in which a swivel means is rotatably mounted. A strap connector element having a strap attachment device integrally connected thereto is pivotally mounted within the socket between certain limits which are defined by the ends of an upwardly extending and curvilinear flange which at least partially defines the socket in which the swivel means of the strap connector element and attachment device are mounted.

10 Claims, 7 Drawing Figures

STRAP HOLDER ASSEMBLY

BACKGROUND OF THE INVENTION

1. Field of the Invention

An assembly for holding one end or a predetermined portion of a strap or like element to a musical instrument or similar device wherein the end attached to the holding assembly is capable of being pivoted within certain limits to allow freedom of movement.

2. Description of the Prior Art

The use of musical instruments such as a guitar, banjo, etc., of course, have been known and utilized by mankind for many years through the utilization of these instruments and similar type instruments which ideally should be supported from the body during use or playing.

While normally, such instruments are not particularly heavy proper support on the body of the user is highly desirable so that both hands can be used for the operation of the instrument. To provide such support the prior art has seen various types of cords, straps, etc., attached to the instrument and suspended from the shoulder or applicable portions of the user's body in a variety of ways.

The following U.S. patents are representative of prior art structures directed to the attaching or mounting of support straps and/or like implements to a musical instrument whereby the instrument can be supported from the body: U.S. Pat. Nos. 2,061,464, to Heimers; 3,138,050, to Tevis; 3,323,698, to Sottile; 3,366,293, to Fyke; 3,372,614, to Galster; 3,512,443, to Parson; 2,643,039, to Sottile; 3,688,012, to Vettel and 3,894,464, to Brooks.

While most of the devices disclosed in the above-referenced patents are operable and serve to adequately connect a strap or similar, related implement to the instrument, the majority are rather unsophisticated in nature and are generally considered to be detrimental to the esthetic effect of the entire instrument by virtue of the non-decorative connecting elements. In addition, the actual structures of such devices are not particularly well suited specifically to use on a musical instrument or like device supported from the body. Inherent in some of these prior art devices is the problem of inadvertent unfastening of the devices, snagging of the connecting element on clothing or other articles and actual damage to the instrument upon attachment thereto.

Accordingly, there is an obvious need in the industry for an attractive, decorative yet efficiently functional means of attaching a strap or like supporting implement directly to the body of a musical instrument in such a matter as to allow free movement of the strap or supporting implement. At the same time such device should be relatively free from snagging and should be sufficiently designed and constructed to eliminate the need for repair, replacement or even the simplest maintenance. Perhaps one of the most important characteristics of a connecting device of the type discussed in its ability to add to the decorative features or esthetic appearance of the instrument itself. This is particularly important when such instruments are used by professionals who normally take great pride in both the performance capabilities of their respective instruments as well as their esthetic appearance.

SUMMARY OF THE INVENTION

This invention relates to a strap holder means which includes one or more holder assemblies preferably mounted in spaced relation to one another on the exterior surface of a musical instrument such as a guitar, banjo or the like. These holder assemblies are specifically designed and configured to engage the opposite ends or predetermined portions of a support strap or like element used to support the instrument on the body of the user. It should be emphasized that while the structure of the present invention is specifically disclosed and described with relation to use in combination with a support strap and/or musical instrument, such structure can be utilized for removably holding or engaging any type of strap like device irrespective of the purpose for which the strap is used. It is specifically not intended that the structure of the present invention be limited for use with a strap for a musical instrument per se irrespective of the description set forth herein or terminology used with regard to a possible, specific application of the strap holder means of the present invention.

More specifically, each of the strap holder means includes a base means having an upstanding flange extending outwardly from substantially the exterior surface of the musical instrument or device on which it is mounted. The flange itself has a curvilinear configuration and accordingly at least partially defined socket means on the interior thereof wherein the flange is disposed in at least partially surrounding relation to the socket means. In one embodiment of the present invention the flange is configured into a substantially semicircular configuration and in the various embodiments of the present invention the flange has oppositely disposed end portions which are arranged in spaced relation to one another.

Swivel means is disposed on the interior of the base means and correspondingly configured to rotatably fit within the formed socket means. The swivel means includes a strap connector element integrally attached thereto and extending outwardly from the socket means of the base means. Due to this outward extention the rotational movement of the swivel means and the integrally attached strap connector element has its rotational or pivotal movement limited through abutting engagement with either of the oppositely disposed end portions of the flange. Accordingly, upon attachment of the strap to the strap connector element a certain amount of pivotal or rotational movement of the end of the strap and accordingly the strap connector element is permitted within predetermined limits. These limits, as set forth above, are defined by the position of the respective, obviously disposed end portions of the flange.

An attachment means is movably, and preferably threadedly connected to the strap holder means in engaging position relative to the end or predetermined portion of the strap being attached thereto.

Another embodiment of the present invention comprises a pivot means disposed in substantially interconnecting relation between the base means and the swivel means wherein by virtue of interconnection between the swivel means and the pivot means, pivotal or rotational movement of the swivel means about the central axis of the socket means is permitted. Each of the strap holder assemblies are mounted or affixed directly to the body of the musical instrument or like device by means of an assembly mounting means. This mounting means may be in the form of a connecting bolt extending completely through wall portion of the instrument wherein a threaded nut and washer arrangement fixedly attaches a threaded end of the bolt to the interior of the instrument. Similar other substantially conventional attachments may be utilized in the form of a threaded screw or like element which is normally applied or removed from the interior of the device.

Another structural feature of the present invention includes the provision of a mounting plate disposed between the base and the exterior surface of the instrument adjacent to which the base means is mounted. This mounting plate is specifically designed to have a decorative configuration and may be made of polished metal or like attractive material which provides both a proper support surface of the base means to the exterior surface of the instrument as well as adding to the decorative and esthetic appearance of the instrument.

This invention accordingly comprises the features of construction, combination of elements and arrangement of parts which will be exemplified in the construction hereinafter set forth and the scope of the invention will be indicated in the claims.

BRIEF DESCRIPTION OF THE DRAWINGS

For a fuller understanding of the nature and the objects of the invention, reference should be had to the following detailed description taken in connection with the accompanying drawings in which.

Similar reference characters refer to similar parts throughout the several views of the drawings.

DETAILED DESCRIPTION

Figure 1:
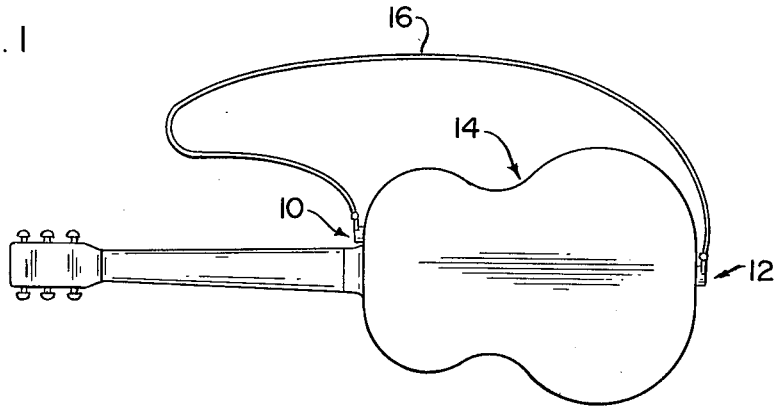
FIG. 1 is a rear plan view of an instrument with a supporting strap attached thereto.
Figure 3:
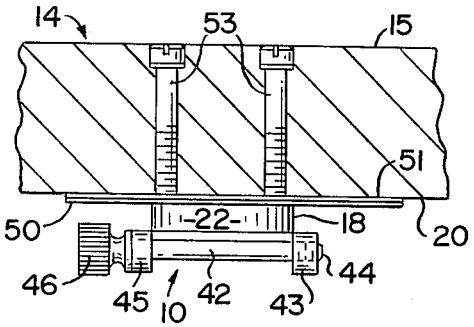
FIG. 3 is a detailed view in partial section showing the assembly mounting means for attaching the embodiment of FIG. 2 and a similar type device.
Figure 6:
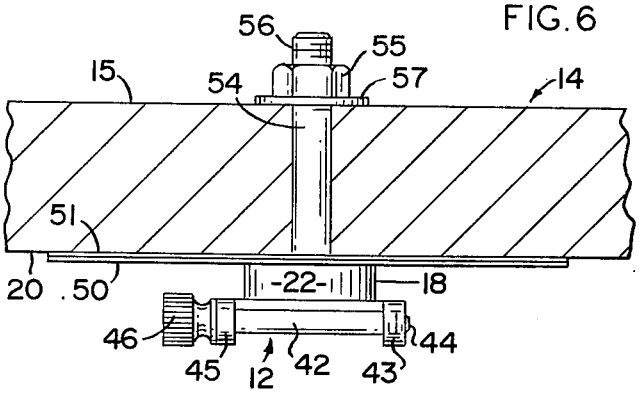
FIG. 6 is a top view of the embodiment of FIG. 5 in partial section showing means of mounting the assembly to the instrument or like device.
Figure 2:
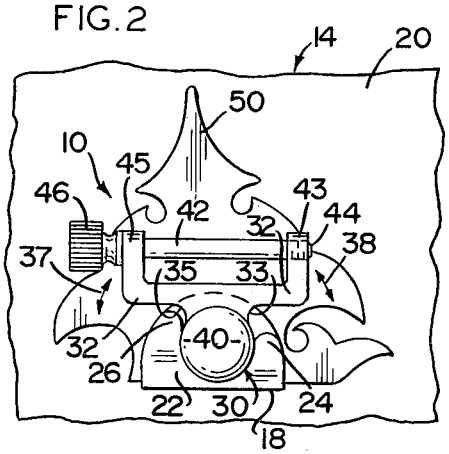
FIG. 2 is a detailed, partial cutaway view showing the exterior structure of one embodiment of the present invention.
Figure 5:
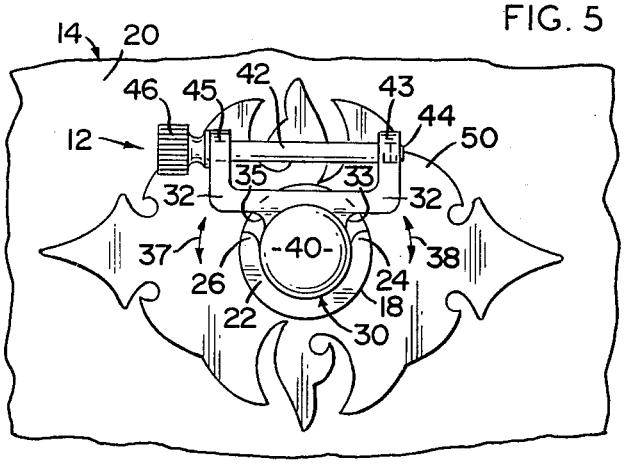
FIG. 5 is a detailed, partial cutaway view of another embodiment of the present invention.
Figure 4:
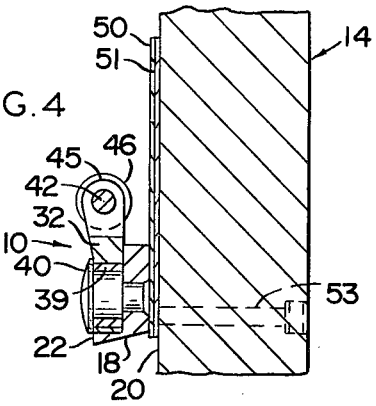
FIG. 4 is a side view of the embodiment of FIG. 2 in partial section showing interior of the base means.
Figure 7:
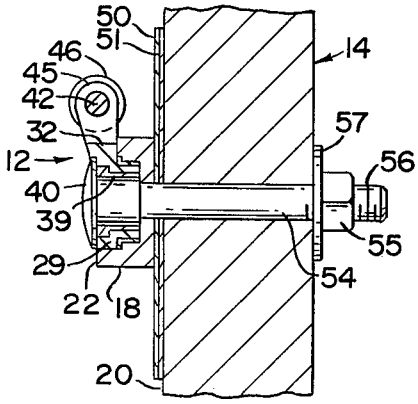
FIG. 7 is a side view of the embodiment of FIG. 5 showing the interior of the base means and means of mounting the assembly to the instrument or like device.

As best shown in FIGS. 1, 2 and 5 the present invention is directed to a strap holder means comprising at least one and preferably two strap holder assemblies generally indicated as 10 and 12 respectively. In the embodiment of the invention shown the instrument generally indicated as 14 has supporting strap 16 attached thereto by virtue of the strap holder assemblies. With reference to FIGS. 2–7 each of the strap holder assemblies comprises a base means 18 extending substantially outwardly from the outer surface 20 of instrument 14 and including a flange 22 having a substantially curvilinear configuration as best shown in FIGS. 2 and 5. This flange has opposite end portions 24 and 26 which define a spaced apart relation between these ends of the flange. Accordingly, in one embodiment (FIG. 5) the flange is configured into a substantially semi-circular configuration. This semi-circular configuration and the fact that the flange 22 is raised from the surface 20 of the instrument 14 at least partially defines a socket means 30 in which swivel means 29 is movably mounted.

The swivel means is essentially correspondingly configured to the interior or socket means defined by the interior portion of the flange and is thereby free to rotate therein. A strap connector element 32 is integrally connected to the swivel means 29 and is disposed to extend outwardly from the socket means and the base means between the ends 24 and 26 of the flange 22. This outward extention of the strap connector element provides an abutting relation between the ends 24 and 26 of flange 22 and portions 33 and 35 of the strap holder element. Accordingly, as indicated by directional arrows 37 and 38 the pivotal or rotational movement of the strap connector element 32 in the direction indicated is limited by abutting relation between portion 35 and end 26 and portion 33 and end 24 respectively. Accordingly, rotational movement of the strap holder element 32 is maintained within limits about the central axis of the socket means and/or swivel means. Additional structure of the present invention includes a pivot means 39 disposed in substantially interconnecting relation between the base means and the swivel means 29. The pivot means further includes a cap element 40 movably attached thereto so as to cover the inner workings and/or interior of the swivel means 29 and its working relation and engagement to the pivot means 39.

Again turning to the belt connector element 32, a belt attachment means 42 is movably and preferably threadedly mounted thereon by virtue of the threaded connection as at 44. At connection 44 the end of the shaft of the attachment means 42 has its exterior surface threaded wherein the interior of the aperture in arm 43 of the belt connector element has its exterior surface threaded. A knurled knob 46 is provided on the opposite end of the shaft of the attachment means 42 and serves to twist the shaft 42 into engagement with the arms 43 and 35 through the respective apertures therein.

Another structural feature of the present invention comprises mounting plate means 50 disposed between the base means 18 and more particularly the under surface of flange 22 and the outer surface 20 of the instrument 14 or like device on which the assembly 10 is mounted. The mounting plate 50 may comprise one or more plate elements 51 and also may be specifically configured into a decorative style or shape as indicated in FIGS. 2 and 5.

The interior assembly is attached to the wall surface of the instrument 14 by substantially conventional attachments including screw threaded fasteners 53 or alternately a bolt 54 and cooperating nut 55 attached to the threaded end 56 of bolt 54. Similarly conventional washer means 57 may be utilized in addition to secure the bolt to the interior surface 15 of the instrument 14 in a manner which is generally known in the art.

It will thus be seen that the objects made apparent from the preceding description, are efficiently attained and since certain changes may be made in the above article without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

Now that the invention has been described, what is claimed is:

1. A strap holder means of the type primarily used for attachment of a strap to a musical instrument or like device, said strap holder means including at least one holder assembly comprising: base means mounted on the instrument and comprising an upstanding flange having a curvilinear configuration along at least a portion of the length thereof, said flange extending outwardly relative to the surface of the instrument, socket means defined substantially on the interior of said base means, swivel means movably connected to said base means, said swivel means movably mounted within said socket means in substantially surrounded relation relative to said flange, said swivel means including a strap connector element attached thereto and extending substantially outwardly from said base means, said strap connector element including attachment means disposed in strap engaging position relative to said strap connector element, whereby the strap is movably connected to the instrument at least at one end thereof.

2. A strap holder means as in claim 1 further comprising pivot means interconnected between said base means and said swivel means and disposed in movable, rotatable relation within said socket means.

3. A strap holder means as in claim 2 wherein said pivot means includes a cap element connected thereto and disposed on the upper portion of said base means in substantially covering relation to a predetermined portion of said swivel means.

4. A strap holder means as in claim 1 wherein said strap connector element is disposed in outwardly extending relation to said socket means and movable into abutting relation with opposite ends of said flange, whereby said strap connector element is rotatable between predetermined limits within said socket means; said limits defined by said ends of said flange.

5. A strap holder means as in claim 4 wherein said flange includes a substantially semi-circular configuration along the length thereof.

6. A strap holder means as in claim 1 further comprising pivot means disposed in interconnecting relation between said base means and said swivel means, whereby said swivel means is rotatably mounted with said socket about the central axis of said socket means.

7. A strap holder means as in claim 1 wherein said attachment means is threadedly connected to the remainder of said strap connector element in strap engaging relation to the strap mounted on the instrument.

8. A strap holder means as in claim 7 wherein said strap connector element is integrally attached to said swivel means, said swivel means correspondingly configured to said socket means and rotatably mounted therein by connection to said pivot means; wherein opposite ends of said flange are disposed in spaced relation to one another and in interruptive relation to the rotational movement of said strap connector element.

9. A strap holder means as in claim 1 further comprising mounting plate means disposed between said base means and the exterior surface of the instrument, assembly mounting means fixedly connected to the instrument and attached to said base means, whereby said base means is mounted on the exterior surface of the instrument.

10. A strap holder means as in claim 1 comprising at least two strap holder assemblies connected to spaced apart portions of the instrument and having opposite ends of the strap connected to separate only of said two strap holder means.

* * * * *